United States Patent [19]

Mowill et al.

[11] Patent Number: 4,657,481

[45] Date of Patent: Apr. 14, 1987

[54] INSERTABLY ADJUSTABLE AND ANGULARLY ADJUSTABLE INLET GUIDE VANE APPARATUS FOR A COMPRESSOR

[75] Inventors: Rolf J. Mowill, Olso; Ivar H. Skoe, Kongsberg, both of Norway

[73] Assignee: Kongsberg Vapenfabrikk, Kongsberg, Norway

[21] Appl. No.: 858,548

[22] Filed: Apr. 4, 3019

Related U.S. Application Data

[63] Continuation of Ser. No. 610,508, May 15, 1984, abandoned.

[51] Int. Cl.[4] ..... F03B 3/14

[52] U.S. Cl. ..... 415/151; 415/155; 415/158; 415/162

[58] Field of Search ..... 415/148, 150, 151, 161, 415/147, 49, 26, 158, 149, 155, 162

[56] References Cited

U.S. PATENT DOCUMENTS

| | | | |
|---|---|---|---|
| 1,322,810 | 11/1919 | Moody | 415/1 |
| 1,821,772 | 9/1931 | Ruthman | 415/175 |
| 1,999,163 | 4/1935 | Allen | 415/175 X |
| 2,155,452 | 4/1939 | Stelzer | 415/98 X |
| 2,405,282 | 8/1946 | Birmann | 415/167 |
| 2,814,431 | 11/1957 | Darrow et al. | 415/158 |
| 2,838,227 | 6/1958 | Thomas et al. | 415/43 |
| 2,858,974 | 11/1958 | Bullock et al. | 415/160 |
| 2,870,956 | 1/1959 | Dhonau et al. | 137/15.1 |
| 2,927,536 | 3/1960 | Rhoades | 415/48 |
| 2,957,424 | 10/1960 | Brundage et al. | 415/48 |
| 3,102,680 | 9/1963 | Fogleman et al. | 415/172 R |
| 3,190,226 | 6/1965 | Judd | 415/198.1 |
| 3,204,863 | 9/1965 | Hausammann | 415/150 |
| 3,318,574 | 5/1967 | Tyler | 415/161 |
| 3,330,532 | 7/1967 | Willi | 415/158 |
| 3,465,950 | 9/1969 | Freid et al. | 68/13 R |
| 3,861,823 | 1/1975 | Serovy | 415/151 |
| 4,003,675 | 1/1977 | Stevens et al. | 415/150 |
| 4,012,908 | 3/1977 | Dundore | 415/161 |
| 4,219,305 | 8/1980 | Mount et al. | 415/13 |
| 4,403,913 | 9/1983 | Fisker | 415/150 |
| 4,428,714 | 1/1984 | Mowill | 415/161 |
| 4,470,256 | 9/1984 | Palmer | 415/150 |
| 4,497,171 | 2/1985 | Corrigan et al. | 415/151 |
| 4,526,507 | 7/1985 | Bingler | 415/170 B |
| 4,527,947 | 7/1985 | Elliot | 415/98 X |

FOREIGN PATENT DOCUMENTS

| | | | |
|---|---|---|---|
| 179275 | 8/1954 | Austria | 415/175 |
| 866145 | 12/1952 | Fed. Rep. of Germany | 415/79 |
| 888207 | 7/1953 | Fed. Rep. of Germany | 415/143 |
| 1011671 | 7/1957 | Fed. Rep. of Germany | 415/158 |
| 1195960 | 11/1959 | France | 415/161 |
| 623994 | 8/1978 | U.S.S.R. | 415/143 |

*Primary Examiner*—Robert E. Garrett
*Assistant Examiner*—John Kwon
*Attorney, Agent, or Firm*—Finnegan, Henderson, Farabow, Garrett & Dunner

[57] ABSTRACT

An inlet guide vane apparatus for the adjustable insertion and retraction of a guide vane into the inlet passage of a compressor and the adjustable varying of the flow direction of the fluid downstream of the vane body by varying the angle of attack of the vane body includes a longitudinal vane body protruding part way across the inlet passage of the compressor through an aperture in the inlet shroud, and a winglet attached to the end of the vane body extending inboard the compressor inlet shroud. The degree of insertion of the vane body into the passage may be controlled by a pneumatically actuated slidable plunger attached to the vane body and responsive to the compressor discharge pressure. The angle of attack of the vane body may be controlled by a rotatable plunger cylinder having a longitudinally extending groove engaging a pin radially extending from a lateral portion of the body of the plunger. The plunger cylinder can be rotated by a synchronizing ring that meshes with a bevel gear fixed to one end of the plunger cylinder. Alternatively, the plunger cylinder may be fixed and have a curved groove wherein the angle of attack can vary with the degree of insertion.

16 Claims, 8 Drawing Figures

INSERTABLY ADJUSTABLE AND ANGULARLY ADJUSTABLE INLET GUIDE VANE APPARATUS FOR A COMPRESSOR

This application is a continuation of application Ser. No. 610,508, filed May 15, 1984, now abandoned.

BACKGROUND OF THE INVENTION

1. Field of the Invention

The present invention involves an adjustably insertable and retractable inlet guide vane apparatus for a compressor.

2. Description of the Prior Art

To improve the efficiency at predetermined power conditions of a compressor having a bladed rotor shaft, guide vanes are positioned in the inlet passage of the compressor. The vanes direct the incoming air flow to impinge upon the rotor blades at a predetermined swirl or angle of attack for optimum transfer of energy from the flow to the rotor shaft. These vanes ordinarily extend across the full width of the inlet passage and may be retractable at different load conditions to effect a changed swirl that is better suited for compressor operation at such conditions. The retraction of conventional retractable inlet guide vanes is generally accomplished by mechanical gearing actuated by a control unit.

The effectiveness of inlet guide vanes depends upon the angle of attack of the vane relative to the incoming flow and the load level of operation of the compressor. The overall efficiency of some compressor inlet configurations can be increased by the use of guide vanes extending only in that part of the inlet passage having the highest proportion of mass flow. However, when the vanes are inserted only part way across the inlet passage, recirculation of the incoming flow around the tip of the vane body can result in losses which reduce efficiency.

SUMMARY OF THE INVENTION

It therefore is the principal object of the present invention to extend the range of efficient operation for retractable inlet guide vanes for a compressor.

It also is an object of the present invention to provide adjustable inlet guide vanes for a compressor that extend the stable operating range for the rotor in addition to extending the range of efficient operation of the rotor.

These and other objects of the present invention, as embodied and broadly described herein, are accomplished in accordance with the purpose of the invention by an inlet guide vane apparatus for adjustable insertion and retraction of a guide vane into the inlet of a compressor having an inlet shroud defining a flow passage and a discharge manifold. The inlet guide vane apparatus of the present invention comprises an aperture in the inlet shroud adjacent a high mass flow region of the flow passage, a vane body having a longitudinal axis, the length of the vane body being significantly less than the cross-sectional width of the flow passage at the location of the aperture, means for controllably inserting and retracting the vane body in the direction of the vane axis through the aperture and into the high mass flow region, means for controllably varying the flow direction of the fluid downstream of the vane body about the longitudinal axis and relative to the flow direction upstream of the vane body in the inlet shroud, and means for reducing recirculation of the inlet air flow around the end of the vane body inboard the shroud.

Preferably, the means for controllably inserting and retracting the vane body through the aperture of the inlet shroud is responsive to the discharge manifold pressure and includes a spring-biased plunger which is actuated by a pneumatic valve.

The means for controllably varying the flow direction includes means for varying the angle of attack of the retractable vane body relative to the flow in the inlet passage surrounded by the inlet shroud and preferably includes a plunger connected to one end of the vane body and a circumferentially, variably positionable plunger sleeve surrounding the plunger. The plunger is longitudinally, slidably engaged in the side of the plunger sleeve which is continuously rotatable within a flange portion of the shroud. Alternatively, the angle of attack can be set discontinuously at one of two predetermined angles or can vary continuously with the degree of insertion of the vane body inboard the inlet shroud.

The means for reducing the recirculation of the inlet air flow around the vane body preferably includes a vane winglet connected to the end of the vane body inboard the inlet passage.

The accompanying drawings, which are incorporated in and constitute a part of this specification, illustrate several embodiments of the invention and, together with the description, serve to explain the principles of the present invention.

DESCRIPTION OF THE PREFERRED EMBODIMENT

Reference will be made in detail to the present preferred embodiments of the invention, examples of which are illustrated in the accompanying drawings. In describing alternative embodiments, parts performing similar functions have the same digits in the two right-hand places and the left-most digit generally is the same as the Figure in which the part is illustrated.

Figure 1A:
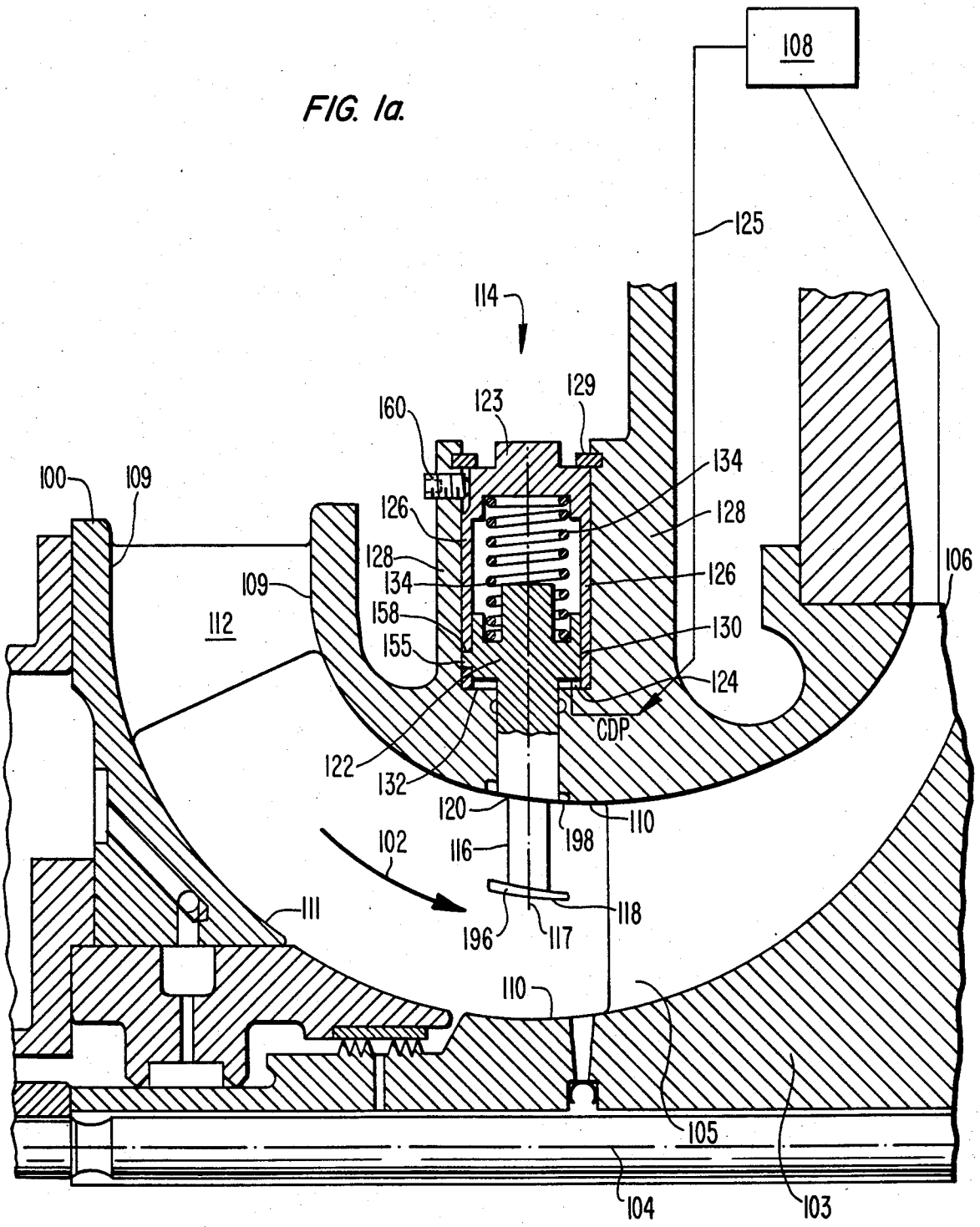
FIG. 1*a* is a schematic view of an embodiment of the present invention.

Referring to FIG. 1*a*, there is shown generally the inlet section of a compressor of the radial type that is used to increase the pressure of a gaseous fluid such as air. The compressor has an inlet shroud 100 defining an inlet flow passage 102 for the incoming gas; a rotor 103 having an axis of rotation 104, a plurality of rotor blades 105, and a rotor exit 106; and a discharge manifold, which is depicted schematically as 108, for receiving the compressed gas. The compressor may have a single entrance (as shown in the figures) or a dual entrance (not shown).

Inlet shroud 100 is of the type having an inlet shroud entrance portion 109 that is generally perpendicularly oriented relative to rotor axis 104. An inlet shroud exit portion 110 is oriented generally parallel to rotor axis 104 and immediately adjacent rotor blades 105. Thus, inlet shroud 100 is said to have radial entrance portion 109 and axial exit portion 110. Shroud portions 109 and 110 are connected by a smoothly curving section, such as intermediate section 111. The present invention, to be described hereinafter, is especially useful with an inlet shroud configuration having an upstream vane with a fixed angle of attack positioned near the shroud inlet, such as fixed vane 112, to impart an initial degree of swirl to the incoming gas. When fixed vane 112 is used in conjunction with a variable geometry decoupled downstream inlet guide vane, such as those made in accordance with the present invention, compressor gas mass flow can be controlled as explained in U.S. Pat. No. 4,428,714.

In accordance with the present invention, the inlet guide vane apparatus includes a vane body having a longitudinal axis. As embodied herein, the inlet guide vane apparatus, which is denoted generally by the numeral 114 in FIG. 1*a*, includes a vane body 116 having a longitudinal axis 117 and an inboard end 118 that is positionable within inlet flow passage 102. Vane body 116 has sufficient body length along longitudinal axis 117 so that vane body 116 is capable of being extended into the inlet flow passage a distance coverng a significant proportion of the width of the inlet flow passage. However, the length of vane body 116 is not long enough to touch or become closely proximate a wall of shroud 100 during maximum insertion of vane body 116 into inlet flow passage 102. Although not shown in the Figures, the cross section of vane body 116 is aerodynamically profiled, as would be understood and appreciated by one skilled in the art.

Further in accordance with the present invention, there is provided an aperture in the inlet shroud adjacent the region of the inlet flow passage with the highest proportionate mass flow per unit of distance traversed across the inlet flow passage, to allow insertion and retraction of the body into that proportionately high mass flow region. As embodied herein, annular-shaped inlet flow passage 102 receives the greater proportion of the incoming mass flow along the wall located farthest from the axial centerline 104 of the compressor depicted in FIG. 1*a*. As embodied herein and with continued reference to FIG. 1*a*, inlet shroud 100 includes an aperture 120 located in the part of shroud exit portion 110 most distant from rotor axis 104. The central axis of aperture 120 coincides with vane body central longitudinal axis 117. Moreover, more than one vane body 116 and corresponding aperture 120 may be present in each inlet passage 102 spaced around the circumference of annular exit portion 110 of shroud 100 to accommodate a plurality of inlet guide vane apparatus 114.

In accordance with the inlet guide vane apparatus of the present invention, means are provided for controllably inserting and retracting the vane body in the direction of the vane body axis through the aperture in the inlet shroud and thus respectively into and out of the high mass flow region of the flow passage. With the compressor discharge manifold functioning as a pressure source, the insertion and retraction means can provide a continuous correspondence between the degree of insertion and the compressor discharge pressure (CDP) over a predetermind range of compressor discharge pressures. The insertion and retraction means also can be constructed so as to provide only either insertion of the maximum length of the vane body or full retraction of the vane body over a predetermined range of compressor discharge pressures.

As embodied herein, and referring still to FIG. 1*a*, the controllable insertion and retraction means includes a vane body plunger 122, a vane body plunger cylinder 123, biasing force means (to be explained below), and a plunger activating pressure chamber 124 pressurized by the compressor discharge pressure via a pressure line 125 communicating with compressor discharge manifold 108.

Vane plunger 122 is attached to an end (out of view in FIG. 1*a*) of vane body 116 outboard inlet passage 102. Plunger 122 is partially enclosed and surrounded by a vane body plunger cylinder 123 that has a cylindrical side sleeve portion 126, and an open end facing opposite a closed end. A side flange portion 128 of shroud 100 is shaped to receive plunger cylinder 123, which is retained in side flange 128 by an annular retaining disc 129. Plunger 122 has a lateral portion 130 which slidably engages side sleeve 126 of cylinder 123. The open end of cylinder 123 is held against an annular, end flange portion 132 of shroud 100 in a position that aligns the central longitudinal axis of plunger cylinder 123 with vane body axis 117 and the central axis of aperture 120.

Plunger activating pressure chamber 124 regulates the movement of vane body plunger 122 along the direction of vane body axis 117 and is formed near the open end of cylinder 123 by an end flange portion 132 of shroud 100, side sleeve 126 and that portion of plunger 122 facing side sleeve 126 and end flange portion 132. Pressure line 125 extends from compressor discharge manifold 108 through shroud 100 at annular end flange portion 132 and communicates with pressure chamber 124. In this way chamber 124 is continuously maintained at the compressor discharge pressure and a commensurate force is applied to plunger 122.

In accordance with the present invention, biasing force means are provided to apply force to the plunger in opposition to the pressure applied to the plunger by the plunger activating pressure chamber. As embodied herein and referring still to FIG. 1*a*, the biasing force means includes at least one vane plunger biasing spring 134 situated between an interior surface of the closed end of vane plunger cylinder 123 and an opposed surface of plunger 122. Each spring 134 provides a biasing force in opposition to the compressor discharge pressure applied against vane body plunger 122 via compressor discharge manifold 108, pressure line 125 and pressure chamber 124. Thus, below a first predetermined value of the compressor discharge pressure, vane body 116 will be fully inserted inboard inlet passage 102. At CDP's greater than this first predetermined value, the force exerted by the CDP on vane body plunger 122 becomes large enough to begin compressing each vane plunger biasing spring 134 and causing partial retraction of vane body 116. At CDP's above a second predetermined value (higher than the first value), vane body 116 will be completely retracted from inboard inlet passage 102. The level of compressor discharge pressure at which vane body 116 becomes fully retracted depends upon the cumulative force constant of each biasing spring 134.

The FIG. 1*a* embodiment of the invention provides a continuous range of vane insertion and retraction in accordance with the level of the compressor discharge pressure and the sensitivity of the plunger biasing springs. The vanes are fully inserted into inlet passage 102 during the lowest operating power condition and fully retracted during operation at powers above a predetermined part power level. At power levels intermediate this predetermined part power level at which the vane becomes fully retracted and the lowest operating power levels, the vanes are partially inserted to varying degrees.

Figure 2:
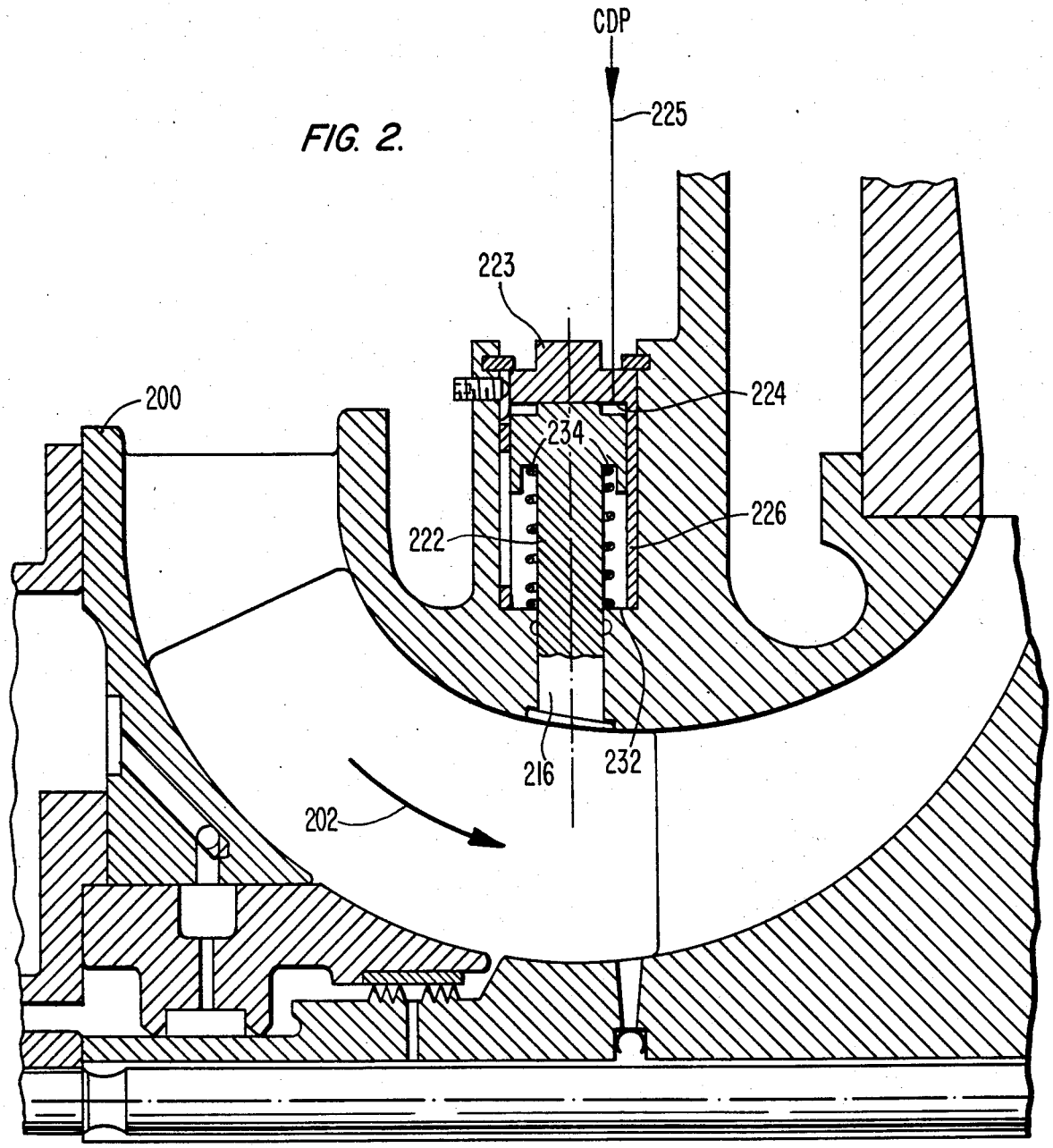
FIG. 2 is a schematic view of a variation of the embodiment of FIG. 1*a;*

In the continuously variable insertion and retraction embodiment of the invention, each vane can be totally immersed inboard inlet passage 102 at part load, as illustrated in FIG. 1*a*. To effect full insertion of the vane body at the higher predetermined values of the compressor discharge pressure and full retraction at the lower operating power levels, a variation of the embodiment of the continuously, controllably variable insertion and retraction means shown in FIG. 1*a* may be used. One such variation of the FIG. 1*a* embodiment is depicted in FIG. 2, in which each vane plunger biasing spring 234 is positioned between end flange portion 232 of shroud 200 and the opposing surface of vane body plunger 222. A pressure line 225 is attached to vane plunger activating pressure chamber 224, which is formed between the interior surface of the closed end of cylinder 223, a part of side sleeve 226 and the surface of plunger 222 that faces opposite the closed end of cylinder 223 and side sleeve 226. Below a first value of CDP, vane body 216 will be fully retracted, as shown in FIG. 2. Above a second predetermined CDP value (higher than the first value), vane body 216 will be fully inserted into flow passage 202 for the FIG. 2 embodiment. At CDP values intermediate the first and second values, vane body 216 will be partially inserted into flow passage 202 to varying degrees. Thus, the maximum length of vane body 216 is inserted at higher loads, completely retracted at lower loads and a continuously variable degree of insertion and retraction of vane body 216 is provided in accordance with the level of the compressor discharge pressure.

Figure 4:
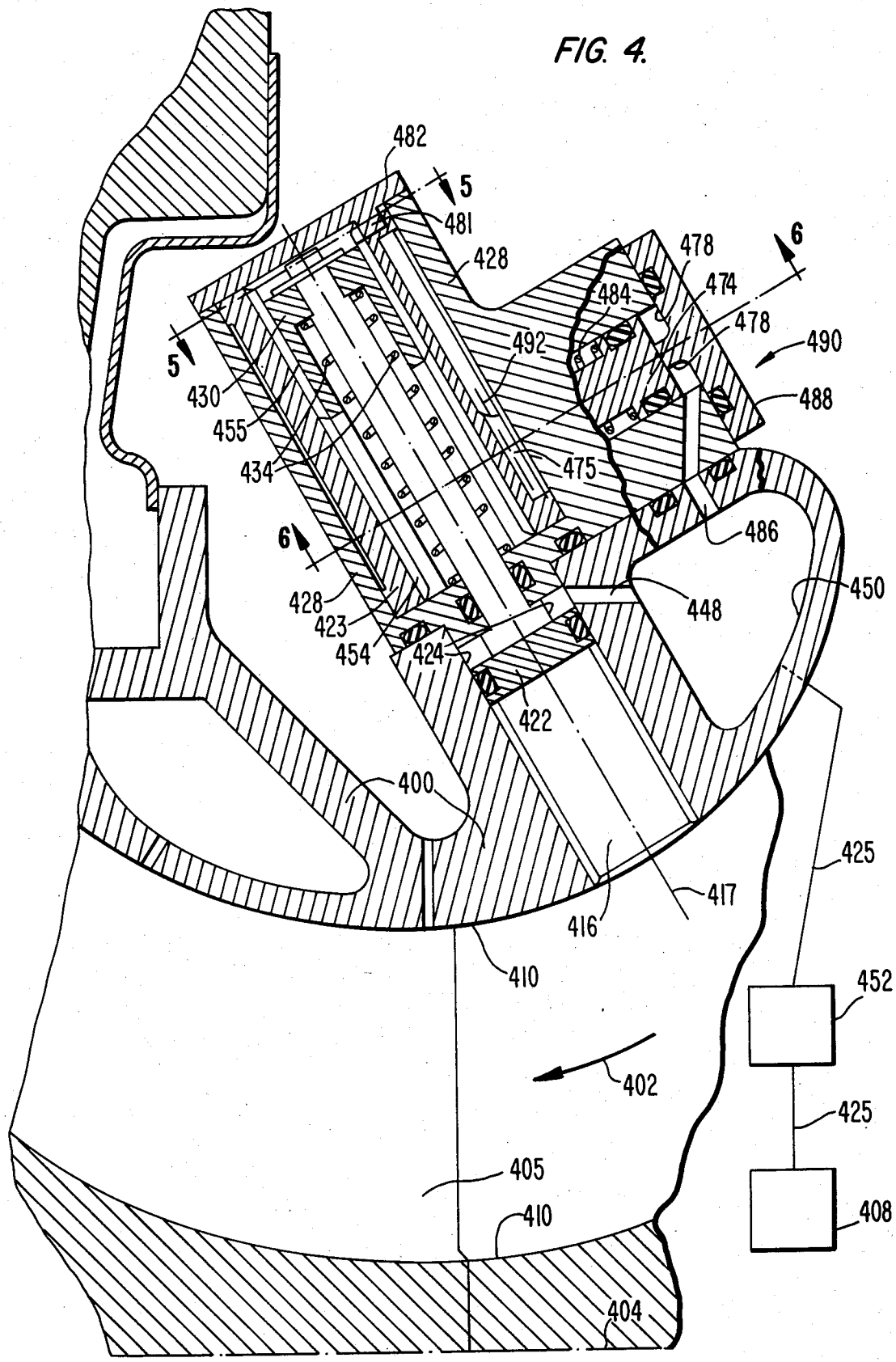
FIG. 4 is a schematic view of yet another embodiment of the present invention.

Another embodiment of the invention that effects insertion of the maximum length of vane body 416 at higher predetermined values of CDP is illustrated in FIG. 4, described below.

In addition to the continuously variable insertion and retraction of the vane body illustrated in the embodiments of FIGS. 1*a* and 2, it is possible to effect a discontinuous insertion and retraction of the vane body in the present invention. In the discontinuous insertion and retraction embodiment, the maximum vane body length is fully inserted below, and the vane body fully retracted above, a single predetermined compressor discharge pressure value, or vice versa, without any partial insertion at other values of CDP. This produces the so-called on/off mode of vane body insertion and retraction.

In accordance with the present invention, valve means is provided for interconnecting the vane body plunger activating pressure chamber with a pressure source via a pressure line. The valve means effects the interconnection only for source pressures greater than a predetermined value. As embodied herein and referring to FIG. 3*a*, a first pneumatic valve 336 includes a first valve plunger 337 represented schematically in FIG. 3*a* by a single line movable left to right and right to left inside valve 336. As shown in FIG. 3*a*, a first port 339 and a fifth port 345 are initially pressurized from compressor discharge manifold 308 via pressure line 325. As the compressor discharge pressure increases, plunger 337 gradually moves toward the left in FIG. 3*a* against the loading of an adjustable spring 338. When the compressor discharge pressure reaches a first predetermined level, plunger 337 trips a pressure regulator so that first port 339 is connected to a third port 341 via a second port 340, causing a second valve plunger 342 in a second pneumatic valve 343 to move to the left in FIG. 3*a* to open instantaneously a connection between a fourth port 344 and fifth port 345. Once these connections have been made, the full compressor discharge pressure is admitted into vane plunger activating pressure chamber 324 via pressure line 325, causing vane body plunger 322 to move the full extent of its stroke against the small load of each vane plunger biasing spring 334 to either insert or retract vane body 316, depending upon the embodiment of the guide vane assembly in use. In the embodiment illustrated in FIG. 3*a*, full retraction of vane body 316 would occur.

When the CDP is reduced from the first predetermined level in the FIG. 3*a* embodiment, plunger 337 gradually moves to the right back to its original position, still maintaining the connection between ports 339, 340 and 341. When the CDP reaches a second predetermined level of pressure (lower than the first predetermined level of CDP), the connection between first and second ports, 339 and 340, is broken and a connection is established between second port 340 and a sixth port 346, which is vented to atmosphere. Valve plunger 342 in second pneumatic valve 343 then breaks the connection between fourth and fifth ports 344 and 345 and establishes a connection between fourth port 344 and a seventh port 347, which is open to atmosphere. The pressure acting on vane plunger 322 via pressure line 325 and activating pressure chamber 324 then falls to atmospheric pressure and vane plunger 322 moves back to the part load position under the load of biasing springs 334 to insert the maximum length of vane body 316 into inlet flow passage 302. The force constant of biasing springs 334 is chosen so that the force exerted by springs 334 at this atmospheric pressure condition becomes just great enough to overcome friction as vane plunger 322 moves back to the part load position of maximum length insertion into inlet passage 302.

Figure 5:
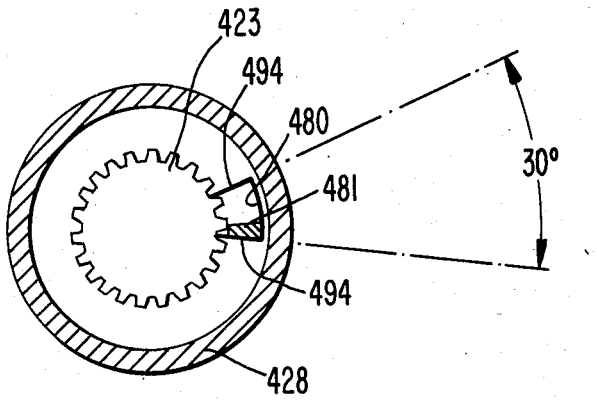
FIG. 5 is a sectional view taken along 5—5 of FIG. 4.
Figure 6:
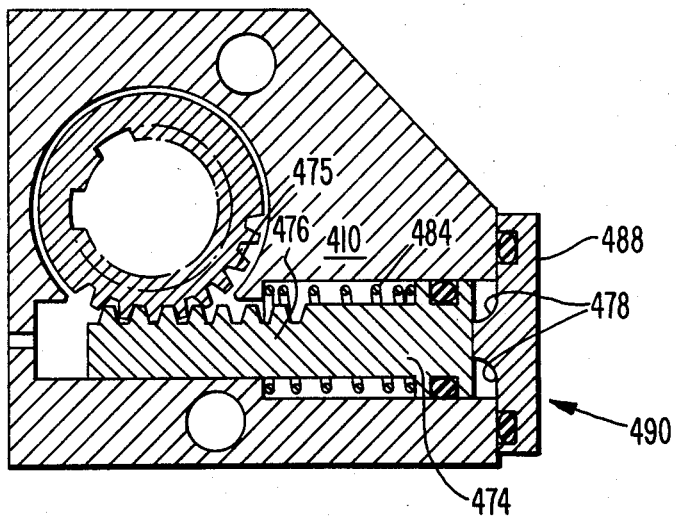
FIG. 6 is a sectional view taken along 6—6 of FIG. 4.

As embodied herein and shown in FIGS. 4, 5 and 6, an alternative embodiment of the means for discontinuously, controllably inserting and retracting the vane body through the aperture into the predominant flow region of the flow passage includes plunger cylinder 423 surrounding the slidably connected to a longitudinally ribbed lateral portion 430 located at one end of a spring biased vane plunger 422, a first pressure passage 448 communicating between an annular pressure plenum 450 and a vane plunger activating pressure chamber 424, a dual-pressure actuating valve 452 and compressor discharge manifold 408.

Plunger cylinder 423 has a plurality of longitudinally extending ribs 454 on its interior surface to engage a corresponding plurality of longitudinally extending ribs 455 on the exterior circumferential surface of lateral portion 430 of vane plunger 422. As plunger 422 moves longitudinally in the direction of vane body axis 417, ribs 455 move slidably against corresponding ribs 454 of plunger cylinder 423, which cannot move in the longitudinal direction within side flange portion 428 of shroud 400.

Annular pressure plenum 450 is connected via first passage 448 with vane plunger activating pressure chamber 424 of vane plunger 422 of vane body 416. Dual-pressure actuating valve 452 controls the pressurizing of annular pressure plenum 450. Valve 452, represented schematically in FIG. 4, operates in response to the compressor discharge pressure and conventionally may include a pair of valves arranged in parallel as known in the art. At a first predetermined value of the CDP in such a parallel valve arrangement, one of the parallel valves opens to permit communication between compressor discharge manifold 408 and annular pressure plenum 450. At this first value of CDP, vane plunger activating pressure chamber 424, which is in communication with annular pressure plenum 450 through first communication passage 448, becomes pressurized at the predetermined first CDP value. At this first predetermined value of CDP, vane body plunger 422 moves along the longitudinal direction of vane body axis 417 to overcome completely the retaining force of plunger biasing spring 434 and insert the maximum length of vane body 416 into flow passage 402. At CDP's below the first predetermined value, valve 452 does not connect pressure plenum 450 with compressor discharge manifold 408. Thus, pressure plenum 450 and pressure chamber 424 are maintained at atmospheric pressure for CDP's below the first predetermined value.

Figure 1B:
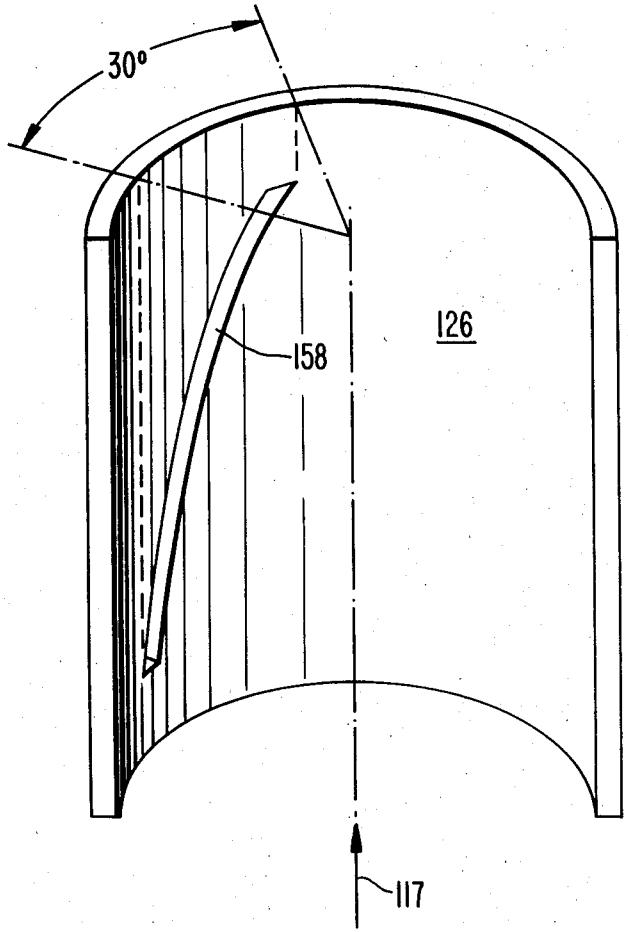
FIG. 1*b* is a perspective view of a portion of a subassembly of the embodiment shown in FIG. 1*a;*

In accordance with the present invention, the inlet guide vane apparatus also includes means for controllably varying the flow direction of the fluid downstream of the vane body relative to the flow direction upstream of the vane body in the inlet shroud. As embodied herein and shown in FIGS. 1*a* and 1*b*, the flow direction varying means includes means for varying the angle of the vane body by rotating the vane body plunger about the longitudinal vane body axis. As further embodied herein and shown in FIGS. 1*a* and 1*b*, the means for varying the angle of attack of the vane body includes a spirally curved groove 158 situated in side sleeve 126 along the direction of vane body axis 117. In this embodiment, vane plunger cylinder 123 is rendered incapable of rotating relative to shroud side flange portion 128 about vane body axis 117 by set screw 160. As depicted in FIG. 1*a*, a pin 155 extends from lateral portion 130 of vane body plunger 122 in a direction transverse to vane body axis 117. Pin 155 engages in slidable fashion with groove 158 to prevent relative rotation between vane plunger cylinder 123 and vane plunger 122, and thus vane body 116 attached thereto, for a particular axial insertion position. However, as groove 158 is curved, as depicted in FIG. 1*b*, the angle of attack of vane 116 varies with insertion depth, and it is possible to predetermine a definite correspondence between the depth of insertion and the angle of attack of vane body 116. Set screw 160 can be released manually to permit rotation of plunger cylinder 123 followed by retightening of set screw 160 during initial calibrations of the compressor and inlet guide vane.

Figure 3B:
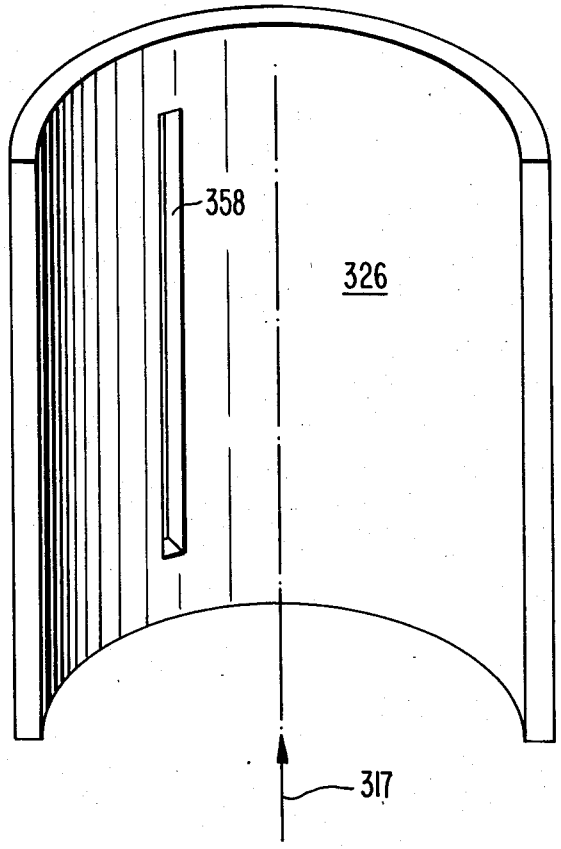
FIG. 3*b* is a perspective view of a portion of a subassembly of the embodiment shown in FIG. 3*a;*
Figure 3A:
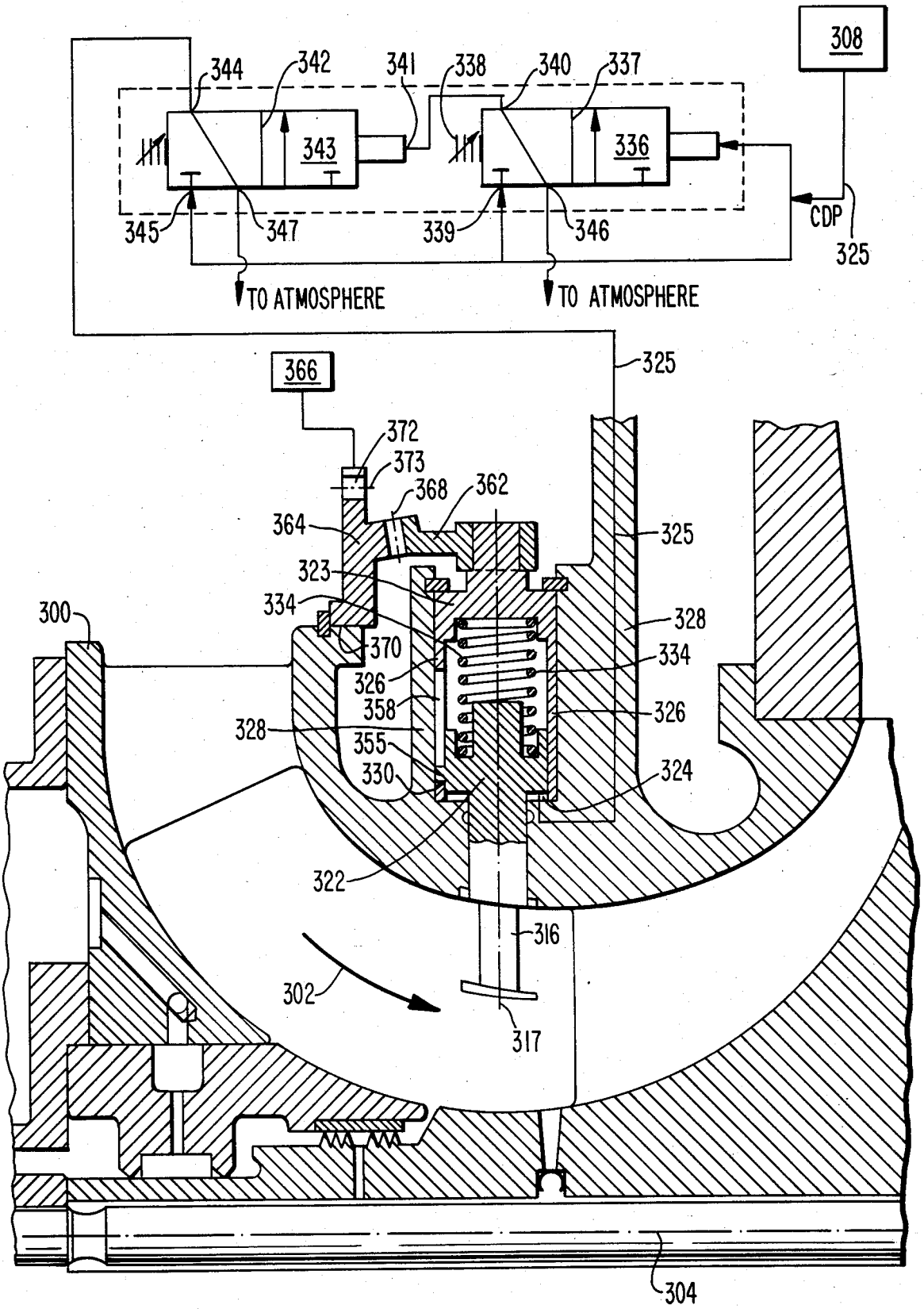
FIG. 3*a* is a schematic view of another embodiment of the present invention.

Another embodiment of the invention having different means for controllably varying the angle of attack of the vane body is shown in FIGS. 3*a* and 3*b*. As embodied therein, the means for controllably varying the angle of attack includes means for rotating the vane body plunger about the longitudinal vane body axis in unison with the vane body plunger cylinder, and means for selectively changing the circumferential location of the plunger cylinder about the longitudinal vane body axis. The means for continuously, selectively changing the circumferential location of the plunger cylinder about the longitudinal vane body axis includes gearing means (described below) operatively connected to rotate the vane plunger cylinder, and a pneumatic or hydraulic actuator means for driving the gearing means.

As embodied herein and shown in FIG. 3*a*, the gearing means includes a bevel gear segment 362 and a synchronizing ring 364. Vane plunger cylinder 323 is purposely rotatable in shroud side flange portion 328 about vane body axis 317. A bevel gear segment 362 is attached at one end to a closed end of plunger cylinder 323 that is remotely situated from vane body 316, and meshes at the other end with a synchronizing ring 364. The interaction between gear segment 362 and synchronizing ring 364 is denoted in FIG. 3*a* by the dashed line designated 368. The axis of rotation of bevel gear segment 362 coincides with vane body axis 317. The axis of rotation of synchronizing ring 364 is compressor rotor axis 304.

As embodied herein, the pneumatic or hydraulic actuator means for driving the gearing means includes a pneumatic or hydraulic actuator 366 (shown schematically in FIG. 3*a*). Acutator 366 controls and causes the rotation of synchronizing ring 364 on an annular bearing surface 370 of shroud 300. The gearing portion of actuator 366 that transmits rotational motion by meshing with ring 364, is represented schematically in FIG. 3*a* and designated by the numeral 372. The interaction between gearing portion 372 and synchronizing ring 364 is denoted in FIG. 3*a* by the dashed line designated 373.

Actuator 366 is controlled in accordance with one or more compressor performance parameters such as compressor rotor speed, compressor discharge pressure, cycle temperature, etc. In this way the angle of attack control means can be operated to change the circumferential location of cylinder 323 relative to inlet shroud 300 in accordance with a predetermined value of the desired performance parameter. For example, the angle of attack control means may respond to the discharge manifold pressure by rotating gearing portion 372 so as to cause synchronizing ring 364 to rotate about rotor axis 304. As ring 364 rotates about rotor axis 304, bevel gear segment 362 interacts with ring 364 along interaction line 368 and bevel gear 362 accordingly rotates about vane axis 317. Vane plunger cylinder 323 rotates in unison with bevel gear segment 362 to change the circumferential location of vane plunger cylinder side sleeve 326, and thus groove 358 (see FIG. 3*b*), relative to shroud side flange portion 328.

As embodied herein and referring still to FIGS. 3*a* and 3*b*, the means for rotating the vane body plunger in unison with the plunger cylinder includes a straight longitudinal groove 358 in side sleeve 326 of plunger cylinder 323 slidably engaging a rib 355 which extends transversely from lateral portion 330 of vane body plunger 322. As the circumferential location of groove 358 changes as described above, vane body plunger 322, engaged therein via pin 355, rotates to change the angle of attack of vane body 316. Moreover, comparable results can be achieved by connecting actuator 366 to a pressure source that is controlled independently of the operating pressures of the compressor.

The particular means for controllably varying the angle of attack that is illustrated in FIG. 3*a* can be used in conjunction with the continuous insertion and retraction means illustrated in FIG. 1*a* and FIG. 2, and vice versa. Although as shown in FIG. 3*b*, groove 358 is straight and parallel to axis 317 of vane body 316, groove 358 could be made curved as shown in FIG. 1*b* for groove 158.

In accordance with the present invention, means are provided for controllably varying the angle of attack of the vane body about the vane axis such that at any one time only one of two possible angles of attack are presented to the incoming flow for all flow regimes with the vane inserted. As embodied herein and shown in FIG. 4, the means for rotating the plunger in unison with the plunger cylinder includes plunger cylinder 423 surrounding a lateral portion 430 of vane body plunger 422. Plunger cylinder 423 has a plurality of longitudinally extending ribs 454 arranged around its inner circumference. Lateral portion 430 of vane plunger 422 is located along the end of vane plunger 422 opposite the end fixed to vane body 416 and has a corresponding plurality of longitudinally extending ribs 455 arranged around its outer circumference as shown in FIG. 4. Plunger cylinder 423 is rotatable around vane body axis 417 relative to shroud side flange portion 428. Each corresponding set of ribs 455, 454 engages one another to permit concentric rotation in unison, while also permitting relative motion in an axial direction between plunger cylinder 423 and lateral portion 430 of vane body plunger 422.

As embodied in the apparatus and shown in FIGS. 4, 5 and 6, the means for selectively changing the circumferential location of the plunger cylinder about the longitudinal vane body axis includes a rack-geared plunger 474, a plurality of outer ribs 475 located around the lower exterior circumference of vane body plunger cylinder 423, a plurality of teeth 476 located along the length of rack-geard plunger 474, a rack-geared plunger activating pressure chamber 478, spring 484 for applying a biasing force opposed to the pressure produced in the rack-geared plunger activating pressure chamber, annular pressure plenum 450, a dual-pressure actuating valve 452 controlling communication of annular pressure plenum 450 with compressor discharge manifold 408 through pressure line 425, a rotation-limiting slot 480 located in the closed end of plunger cylinder 423 and having an end wall 494 at each end thereof, and a downwardly extending stationary protrusion 481 of a shroud end plate 482.

FIG. 4 shows a cross section of annular pressure plenum 450 formed in shroud 400. First communication pressure passage 448 connects plenum 450 with vane plunger activating pressure chamber 424 formed in the space between a flange surface of plunger 422 and an oppositely facing flange surface of shroud 400. A second communication passage 486 connects annular pressure plenum 450 with rack-geared plunger activating pressure chamber 478 that is formed between a portion of shroud 400, an end surface of rack-geared plunger 474 and an oppositely facing end plate 488 of a rack-gear actuator unit which is designated generally in FIGS. 4 and 6 by the numeral 490. Rack-gear actuator unit 490 includes rack-geared plunger 474 and rack-geared plunger biasing spring 484.

In the FIG. 4 embodiment of the present invention, valve 452 controls the pressurizing of annular pressure plenum 450 and thus, pressure chambers 424 and 478. Valve 452, represented schematically in FIG. 4, operates to supply only two predetermined values of pressure to plenum 450. At this first predetermined pressure value, vane plunger 422 moves in the direction of vane axis 417 to overcome completely the retaining force of biasing spring 434 and thus to insert the maximum length of vane body 416 into flow passage 402. The spring force constant of rack-geared plunger biasing spring 484 is chosen to be significantly greater than the spring force constant of vane plunger biasing spring 434. Thus, though vane plunger biasing spring 434 becomes fully compressed at the first predetermined value of CDP, rack-geared plunger biasing spring 484 remains essentially uncompressed at this same predetermined first pressure value.

The second predetermined pressure value is considerably higher (a least by one atmosphere) than the first predetermined value such that pressurizing of rack-geared plunger activating pressure chamber 478 causes rack-geared plunger 474 to completely compress rack-geared plunger biasing spring 484. As rack-geared plunger 474 moves to compress biasing spring 484, the engagement between outer ribs 475 of plunger cylinder 423 and teeth 476 of rack-geared plunger 474 (represented in FIG. 4 by a dashed line 492) causes plunger cylinder 423 to rotate about vane body axis 417. As shown in FIG. 4, shroud end plate 482 has protrusion 481 extending axially toward vane body 416. Protrusion 481 cooperates with slot 480 to constrain rotations of plunger cylinder 423 to a predetermined arc. As plunger cylinder 423 is rotated by rack-geared plunger 474 during applications of the second pressure value, protrusion 481 abuts a respective end wall 494 of slot 480 to positively prevent further rotation of plunger cylinder 423 (see FIG. 5). Shroud end plate 482 can be made angularly adjustable to allow accurate positioning of arcuate slot 480 during calibration of the compressor.

When the pressure in plenum 450 falls below the second predetermined value back to the first predetermined value, in accordance with compressor discharge manifold pressure changes as modulated by valve 452, rack-geared plunger biasing spring 484 becomes completely uncompressed and accordingly moves rack-geared plunger 474 until vane body plunger cylinder 423 engaged therewith ceases rotation as a result of opposite end wall 494 abutting the other side of stationary protrusion 481. It is preferred that the two angle of attack settings made possible by this embodiment of the invention differ by an angular separation of 30° or less, as shown in FIG. 5. The circumferential length of slot 480 is determined in accordance with this criterion of angular separation.

When the maximum length of vane body 116 is inserted into passage 102, as shown in FIG. 1*a* for example, vane body 116 extends only part way across the width of passage 102. Thus, inboard end 118 of vane body 116 becomes subject to end effects that cause recirculation of the incident flow around end 118 of vane body 116. This recirculation is undesirable because it can result in losses which reduce efficiency.

In accordance with the present invention, means are provided for reducing recirculation of the inlet air flow around the inboard end of the vane body. As embodied herein and with reference to FIG. 1*a*, a winglet 196 is attached to inboard end 118 of vane body 116. Winglet 196 is aerodynamically shaped to reduce end effects and also is configured to form a smooth continuous boundary with the interior surface of inlet passage 102 of inlet shroud 100 when vane body 116 is completely retracted. To faciliate formation of this smooth, continuous boundary, a shallow depression 198 approximately equal to the shape and depth of winglet 196 is provided in shroud 100 to border the circumference of aperture 120. When vane body 116 is completely retracted from inboard inlet passage 102, winglet 196 closes compressor inlet passage 102 by sealing aperture 120. When vane body 116 becomes immersed inboard inlet passage 102, the winglet eliminates the vane end leakage flow from the pressure to the suction sides and thus reduces vane end pressure losses and enhances the desired effect of the vane immersion during off-design load conditions.

It will be apparent to those skilled in the art that various modifications and variations could be made in the inlet guide wave apparatus of the present invention without departing from the scope or the spirit of the invention.

What is claimed is:

1. An inlet guide vane apparatus for adjustable insertion and retraction of a guide vane into the inlet of a radial compressor having a rotor with a rotor axis of rotation and an inlet shroud defining a flow passage to said rotor, said inlet shroud having a generally radial entrance portion smoothly curving to an exit portion oriented generally axially relative to said rotor axis, the apparatus comprising:

an aperture in said inlet shroud adjacent a high mass flow region of the flow passage, said aperture being positioned adjacent said axial exit portion and distant from said rotor axis;

a vane body having a longitudinal axis, the maximum length of said vane body capable of being inserted into the flow passage being significantly less than the cross-sectional width of the flow passage at the location of said aperture;

means for controllably inserting and retracting said vane body in the direction of said vane axis through said aperture and into said region, said vane axis being oriented substantially perpendicular to said rotor axis;

means for controllably varying the flow direction of the fluid downstream of said vane body relative to the flow direction upstream of said vane body in the inlet shroud, said flow direction varying means including means for controllably rotating said vane body about said axis for varying the angle of attack said vane body presents to said fluid at a given axial location along said vane body; and means for reducing recirculation of the inlet air flow around the end of said vane body inboard the inlet shroud, wherein said recirculation reduction means includes a vane winglet connected to said inboard end of said vane body and rotatable with said vane body about said vane axis.

2. An inlet guide vane apparatus as in claim 1, wherein said vane body insertion and retraction means includes:

(a) a plunger having one end fixed to, and extending from, the end of said vane body opposite said inboard end;

(b) a plunger cylinder surrounding and slidably engaging a portion of said plunger;

(c) a first plunger activating pressure chamber located near one end of said plunger, said first chamber for applying pressure to said plunger;

(d) a pressure source operatively connected to said first pressure chamber, the pressure of said pressure source varying in accordance with compressor operating conditions; and (e) biasing force means for applying force to said plunger in opposition to the pressure applied by said first chamber.

3. An inlet guide vane apparatus as in claim 2, wherein said vane body moves relative to the inlet shroud in accordance with the force equilibrium produced by the interaction of said biasing force means and the pressure in said plunger activating pressure chamber to vary accordingly the degree of insertion of said vane body inboard the inlet shroud.

4. An inlet guide vane apparatus as in claim 2, also including valve means for interconnecting said pressure chamber and said pressure source only for source pressures greater than a predetermined value.

5. An inlet guide vane apparatus as in claim 2, wherein the compressor also has a compressor discharge manifold and wherein said pressure source is the compressor discharge manifold.

6. An inlet guide vane apparatus as in claim 2, wherein said vane body angle of attack varying means includes:

(a) means for selectively changing the circumferential location of said plunger cylinder about said longitudinal vane body axis; and (b) means for rotating said plunger about said longitudinal vane body axis in unison with said plunger cylinder.

7. An inlet guide vane apparatus as in claim 6, wherein said means for rotating said plunger in unison with said plunger cylinder includes:

(a) at least one longitudinally extending groove formed in said plunger cylinder and extending in a direction parallel to said longitudinal vane body axis; and (b) at least one protrusion extending transversely from said plunger relative to said longitudinal axis of said vane body and slidably engaging said groove.

8. An inlet guide vane apparatus as in claim 2, wherein said vane body angle of attack varying means includes a groove formed in said plunger cylinder and a pin mounted in said plunger and followingly engaging said groove, said groove being spirally curved in the direction of said vane longitudinal axis.

9. An inlet guide vane apparatus as in claim 6, wherein said means for selectively changing the circumferential location of said plunger cylinder includes:

(a) gear means operatively connected to rotate said plunger cylinder;

(b) pressure sensitive actuator means for driving said gear means; and (c) a second pressure source operatively connected to said actuator means, said second pressure source being variable in accordance with compressor performance.

10. An inlet guide vane apparatus as in claim 9, also including positive stop means for constraining rotational movement of said plunger cylinder between two predetermined angular positions relative to said vane axis.

11. An inlet guide vane apparatus as in claim 6, wherein said means for selectively changing the circumferential location of said plunger cylinder about said longitudinal vane body axis includes:

(a) a rack-geared plunger having a plurality of teeth along the length thereof and positional tangentially to said plunger cylinder;

(b) a second activating pressure chamber located near one end of said rack-geared plunger for applying pressure to said rack-geared plunger;

(c) second biasing force means for applying a biasing force to said rack-geared plunger in opposition to pressure applied to said rack-geared plunger by said second pressure chamber;

(d) said pressure source being operatively connected to said second pressure chamber; and (e) means on said plunger cylinder for engaging said teeth of said rack-geared plunger, for rotating said plunger cylinder about said vane body longitudinal axis upon lengthwise movement of said rack-geared plunger in response to the equilibration between the biasing force and the pressure applied to said rack-geared plunger.

12. An inlet guide vane apparatus as in claim 11, also including:

(a) a slot spanning a predetermined arc formed in one end of said plunger cylinder, said slot having an abuttable end wall at each circumferential end of said arcuate slot; and (b) a shroud end plate disposed near said slot and having a stationary protrusion extending into said slot for limiting rotation of said cylinder when said protrusion abuts against each end wall of said slot.

13. An inlet guide vane apparatus as in claim claim 1, wherein when said vane body is completely retracted, said vane winglet forms a smooth continuous boundary with the inlet shroud for sealing said aperture.

14. An inlet guide vane apparatus as in claim 1, wherein said insertion and retraction of said vane body occurs in a direction parallel to said longitudinal axis of said vane body.

15. An inlet guide vane apparatus as in claim 8, wherein said vane insertion and retraction means is mounted outboard the inlet shroud.

16. An inlet guide vane apparatus as in claim 11, wherein the degree of inserton of said vane body inboard the inlet shroud is at a maximum when the compressor is operating at part load.

* * * * *